United States Patent [19]

Szczepanski

[11] Patent Number: 4,819,943

[45] Date of Patent: Apr. 11, 1989

[54] PUTTING PRACTICE DEVICE AND METHOD

[76] Inventor: Harry Szczepanski, 755 Oakleign, NW., Grand Rapids, Mich. 49504

[21] Appl. No.: 69,775

[22] Filed: Jul. 6, 1987

[51] Int. Cl.[4] ..... A63B 69/36

[52] U.S. Cl. ..... 273/186 C; 273/162 F; 273/164

[58] Field of Search ..... 273/186 C, 164, 192, 273/162 F, 183 D, 186 A, 186 R, 162 R, 163 R, 163 A

[56] References Cited

U.S. PATENT DOCUMENTS 3,844,569 10/1974 Swanson ..... 273/192

3,885,796 5/1975 King ..... 273/186 C 4,659,083 4/1987 Szczepanski ..... 273/164

FOREIGN PATENT DOCUMENTS 28759 of 1913 United Kingdom ..... 173/162 F 314278 6/1929 United Kingdom ..... 273/162 F

*Primary Examiner*—George J. Marlo

*Attorney, Agent, or Firm*—Waters, Morse & Harrington

[57] ABSTRACT

A thin rod is removeably received in the hollow shaft of a golf putter. When the rod is removed and placed on the ground, it interacts with reference indicia on the top of the club head to indicate deviation or alignment of the club position and movement with respect to a proposed direction of ball travel.

5 Claims, 4 Drawing Sheets

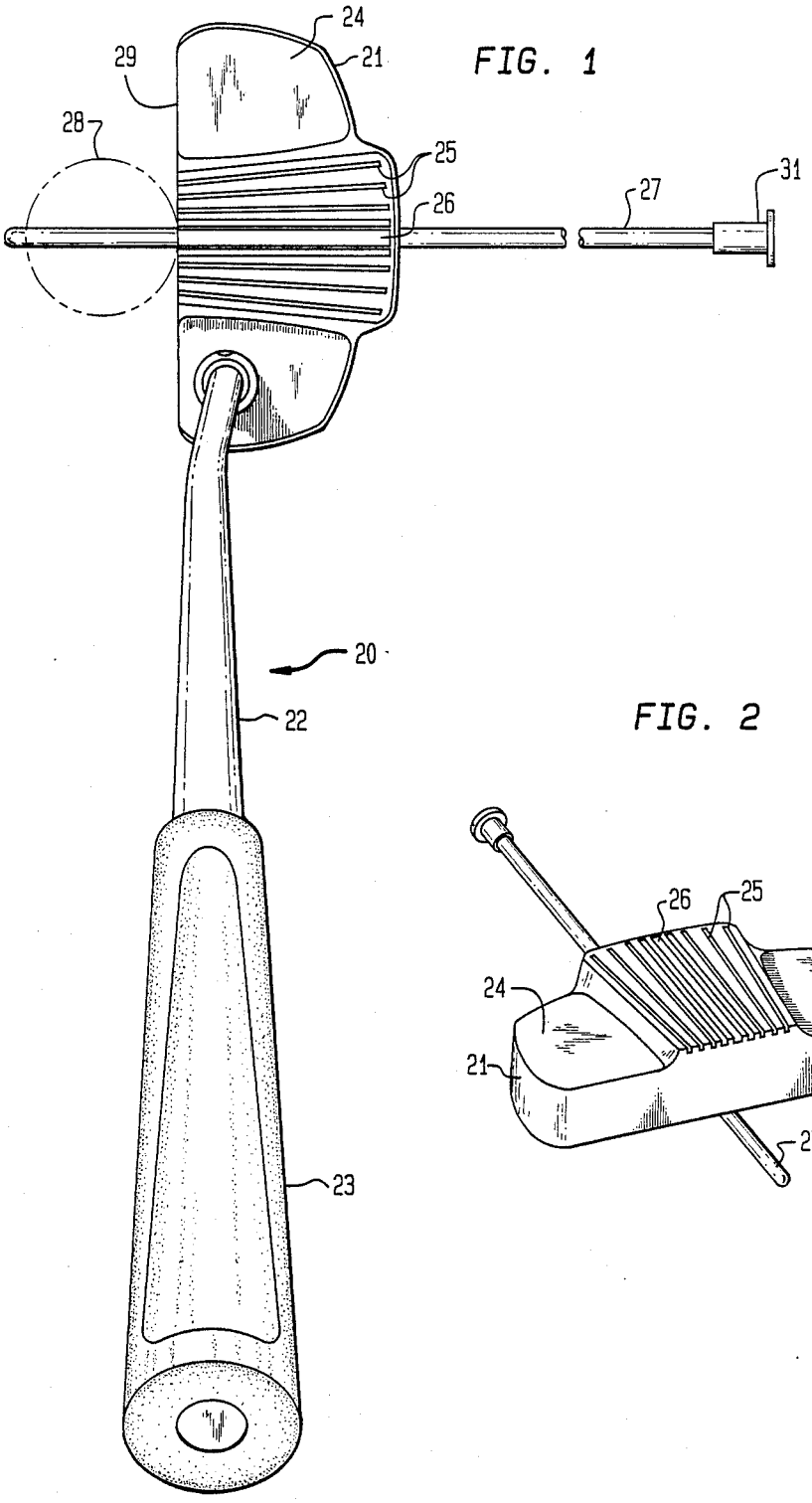
FIG. 1
FIG. 2
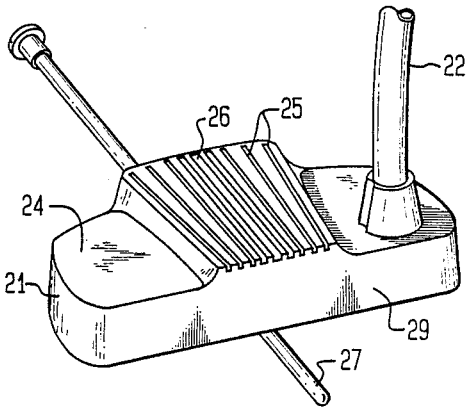

PUTTING PRACTICE DEVICE AND METHOD

BACKGROUND OF THE INVENTION

The putting green is responsible for half of the strokes in a round of par golf. The spectacle of professional golfers missing four-foot putts is well-known. The reason is complex and elusive. The light forces involved result in the need for delicate muscle control reaching almost to the level of surgical skill. To make analysis even more difficult, there are a few optical illusions to contend with, and some complex projection geometry. For reliable and consistent accuracy, the club face must be square to the proposed path of the ball at the instant of impact, and also either (a) the path of the club head at the point of impact must be tangential to the ball path, or (b) the movement of the point of impact must be in a vertical plane containing the path of ball movement. If a putting stroke is based upon (a), the point of impact must be precisely located along the line of the ball path, or slight lateral movement of the head with respect to the ball path occurs. This adds another variable. If a stroke is based upon (b), there must be a high order of skill in converting what tends to be a swinging from an indeterminate axis into a movement that does not allow the club head to shift to either side of the ball path. The optical illusions center in the fact that the player's eyes are rarely directly above the ball, and are thus usually out of the vertical plane containing the ball path. From this viewpoint, curved lines of movement of the club head can appear straight, and vice versa.

Golfers have long been groping for assistance in developing putting skills. Elaborate training devices have been devised and developed, some involving complex electronic equipment giving all sorts of readout information, all at very considerable cost and handling inconvenience. Another type of device provides confinement rails for forcing the user to cause the club head to follow a particular path of swinging movement. A common and very simple system involves the stretching of a line between pegs in the ground, and stroking the putter over it. When something goes haywire in a golfer's putting in the middle of a round, something is needed right then to guide him in finding out where his coordination has gone bad, and correcting it. That something should be (1) easily handled, (2) occupy zero to minimum space in the golfing bag, and (3) be unlikely to be mislaid.

SUMMARY OF THE INVENTION

A reference rod is stored in the hollow shaft of a golf putter, and releaseably retained at the end of the shaft at the grip. The rod may be placed on the ground, where it interrelates with line indicia on the top of the club head so that the rod appears to be continuous over the club head when the club is properly aligned over the rod. The reference line is superimposed on the vertical projection of the rod where it is intercepted by the club head. When in storage position, a means is provided for stopping any tendency for the rod to rattle in the shaft as the ball is struck.

DESCRIPTION OF THE DRAWINGS

FIG. 1 is a top view in perspective, showing a putter properly aligned over the reference rod at the point of impact with the ball, as viewed from a position directly above the reference rod.

FIG. 2 is a perspective view from the front quarter, showing the club aligned over the reference rod.

DESCRIPTION OF THE PREFERRED EMBODIMENTS

Figure 3:
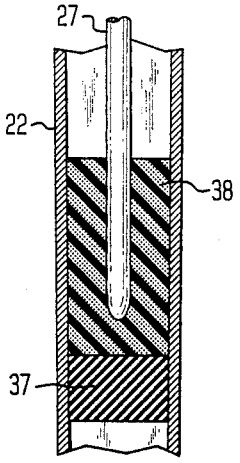
FIG. 3 is a fragmentary section showing a means for preventing the rattling of the reference rod when in storage position in the club shaft.

The putter generally indicated at 20 has a head 21, and a shaft 22 terminating at its upper extremity in the grip 23. The top surface 24 of the putter head is provided with a series of converging reference lines 25, and the central reference line 26 preferably located directly above the impact center of the club head 21. This configuration is described and claimed in my U.S. Pat. No. 4,659,083. The present invention utilizes this configuration in conjunction with a reference rod 27, which can be laid upon the ground so that the putter head can be stroked above it as shown in FIG. 1. While the illustrated pattern of converging lines is the preferred arrangement, a single full line, or even a short central line or dot on the top surface of the putter head can be made to track visually along the reference rod, as seen from above. These short reference marks, however, do not clearly indicate angular deviation of the head. The position of a ball which would be struck, if it were present, is indicated in dotted lines at 28. The striking face 29 of the club head is in a plane perpendicular to the reference rod 27, which is laid on the ground to simulate a selected direction of ball travel. The reference line 26 and the rod 27 should be of the same color, and of comparable width. With the alignment shown in FIG. 1, a ball should proceed along this line. This condition is illustrated schematically in FIG. 10.

It has been recommended by some who have studied putting seriously that the player practice has stroke coordination without the ball being in place, and the present system is ideal for this. After the stroke has been refined and reduced to a habit pattern of muscular responses, the ball may again be used. The inital practice should apparently also be without reference to a hole, so that all attention can be put on the stroke to the exclusion of distractions.

Figure 8:
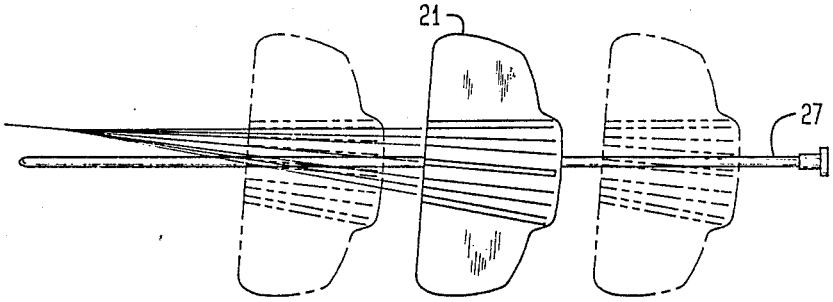
FIG. 8 is a schematic illustration showing the position of the club head at three successive stages along a path of swinging movement, with the club face "opened".
Figure 9:
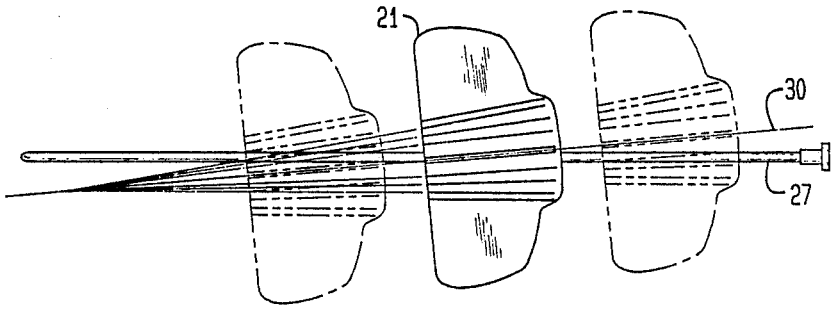
FIG. 9 shows a schematic illustration at three different positions of the club head along is path of swinging movement, with the club face "closed", and the direction of club movement deviating from the proposed path of ball travel corresponding to the position of the reference rod.
Figure 10:
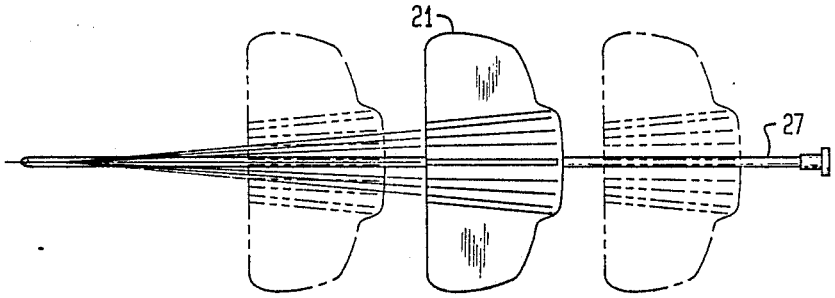
FIG. 10 shows a schematic illustration of three positions of the club head along a swinging movement, with the club head properly oriented, and the path of the club head corresponding to the reference rod.

Referring to FIGS. 8, 9, and 10, various possible positions of the club head and path of swinging movement are illustrated. In FIG. 8, the path of swinging movement of the club head is causing the point of impact on the club face 24 to move in the vertical plane containing the reference rod 27. The club head, however, is rotated slightly clockwise with respect to the position shown in FIG. 1, causing the club face 29 to be "opened". In FIG. 8, the club head is shown in an opposite displacement, with the club face rotated counterclockwise, to a "closed" position. In addition to the angular displacement of the club head from that shown in FIG. 1, the path of movement of the club head indicated at 30 is at an angle with respect to the vertical plane passing through the reference rod 27, cutting across it as shown. The resulting path of a ball struck under these conditions would veer considerably to the left of the desired direction.

Figure 5:
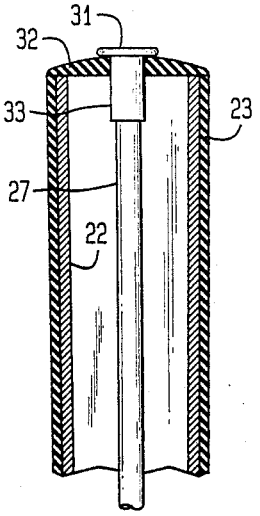
FIG. 5 is a fragmentary section at the upper extremity of the handle grip, showing the reference rod in storage position.
Figure 6:
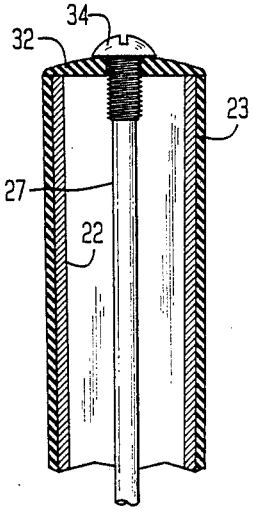
FIG. 6 shows a modified form of the invention with regard to the retention of the reference rod in the shaft.
Figure 7:
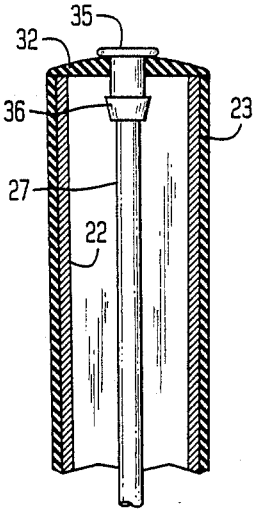
FIG. 7 shows a further modification of the invention with regard to the retention of the reference rod in the shaft.

The reference rod 27 can conceivably be of almost any material. Preferably, it is formed from straightened steel rod approximately 0.093" to 0.125" inches in diameter. The length is preferably in the neighborhood of 18" to 24" inches. A convenient handle for manipulating the reference rod, particularly when it is inserted and removed from storage position in the shaft, is provided by a hollow rivet 31 selected so that the inside diameter of the rivet can form a press fit with the reference rod 27. Referring to FIG. 5, the grip 23 of the usual golf club is of a rubber-like material extending across the end 32 of the shaft 22. The standard grip is already provided with a central opening at the end 32, and this is utilized by the arrangement shown in FIG. 5 for retaining the reference rod 27 in position. The outside diameter of the shank 33 of the rivet is selected for a gentle push fit in this standard end opening in the grip. The resulting friction adequately retains the reference rod in storage position when the club is inverted for insertion into the golf bag. In FIG. 6, a screw 34 is affixed by either welding or adhesive to the end of the reference rod 27, with the threads of the screw providing an increased interengagement with the material of the grip at the end of the shaft. In FIG. 7 a further modification is illustrated in which a device similar in shape to a shirt stud, indicated at 35, is secured to the end of the rod 27, with the enlargement 36 providing a more positive retention of the rod in the shank of the club. In the arrangements shown in FIGS. 5 and 7, the rod can be withdrawn from storage position by slipping the fingernails or a blade under the head of the rivet, and simply pulling the rod out of engagement with the grip material. In FIG. 6, the rod should be removed with a screwdriver or a a coin adapted to engage the slot of the screw.

Figure 4:
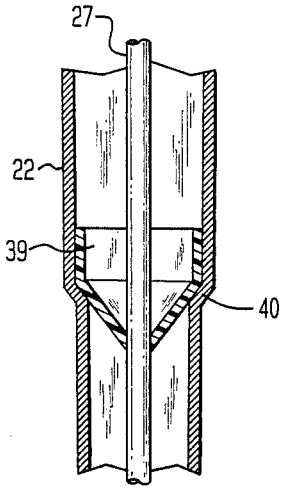
FIG. 4 is a modified form of the invention showing an alternative form of rattle prevention.

It is obvious that a reference rod retained solely at its upper extremity would rattle on impact of the club head with the ball, which is clearly undesireable. In FIG. 3, this is prevented by the addition of a plug 37 pushed down into the shank 22 to form a stop to a collection of loose material indicated at 38 which the inner end of the rod is forced into on insertion into the shank of the club. The loose material may be a mat of fiberglass, a handful of loose sand, or practically anything that can be penetrated by the rod 27. It is only necessary that the mass of material 38 be in the position illustrated in FIG. 3 when the club is generally vertical. In FIG. 4, a modified form of anti-rattle system involves a plastic device 39 pressed down into the tapered shaft 27 until its progress is impeded at the annular offset 40, where it can be retained either by the effect of a press fit, or by adhesive. The device 39 preferably has a conical lower end with a slot or hole capable of receiving the reference rod 27, and the interengagement shown in FIG. 4 obviously prevents the rod from rattling against the inside of the shaft as the ball is struck.

I claim:

1. A method of aligning a putting stroke, comprising:

removing a reference rod from storage position in the shaft of a putter, and placing said reference rod upon the ground in a selected direction;

stroking said putter so that the head thereof moves above said rod, said putter head having a central reference mark on the top surface of said head, said reference mark moving along the vertical projection of said rod interrupted by the presence of said head; and inserting said rod into said storage position in the shaft of said putter at the grip end thereof.

2. A golf putter having a head providing a striking face and an alignment line perpendicular to said face and extending across said top surface, and over substantially the full width of said head, and additionally including converging marks on opposite sides of said alignment line, and also having a tubular shaft secured to said head, wherein the improvement comprises:

a reference rod removably received in said shaft, said rod having a length substantially greater than the width of said head, said rod and alignment line being of similar color.

3. A golf putter having a head providing a striking face and a central reference mark on the top surface of said head, and also having a tubular shaft secured to said head, wherein the improvement comprises:

a reference rod removably received in said shaft, said rod having a length substantially greater than the width of said head, said shaft having a grip of resilient material extending over the end of said shaft, and said rod is received through an opening in said material at said end.

4. A golf putter as defined in claim 3, wherein said rod has a head interengageable with said grip to releaseably retain said rod in said shaft, said rod head having a portion extending over said end adjacent to said opening.

5. A golf putter having a head providing a striking face and a central reference mark on the top surface of said head, and also having a tubular shaft secured to said head, wherein the improvement comprises:

a reference rod removably received in said shaft, said rod having a length substantially greater than the width of said head; and means in said shaft, including a mass of displaceable material normally forcibly engaged by said rod to isolate said rod from the wall of said shaft.

* * * * *